US008355911B2

(12) United States Patent
Zhan et al.

(10) Patent No.: US 8,355,911 B2
(45) Date of Patent: Jan. 15, 2013

(54) METHOD OF LOST FRAME CONCEALMENT AND DEVICE

(75) Inventors: Wuzhou Zhan, Shenzhen (CN); Dongqi Wang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 294 days.

(21) Appl. No.: 12/637,295

(22) Filed: Dec. 14, 2009

(65) Prior Publication Data

US 2010/0094642 A1 Apr. 15, 2010

Related U.S. Application Data

(63) Continuation of application No. PCT/CN2008/071314, filed on Jun. 13, 2008.

(30) Foreign Application Priority Data

Jun. 15, 2007 (CN) ..... 2007 1 0074989

(51) Int. Cl.
*G10L 21/02* (2006.01)
*G10L 21/00* (2006.01)

(52) U.S. Cl. ..... 704/228; 704/226; 704/201

(58) Field of Classification Search ..... 704/228
See application file for complete search history.

(56) References Cited

U.S. PATENT DOCUMENTS 5,615,298 A * 3/1997 Chen ..... 704/228
5,907,822 A * 5/1999 Prieto, Jr. ..... 704/202
6,952,668 B1 * 10/2005 Kapilow ..... 704/206
7,711,563 B2 * 5/2010 Chen ..... 704/262
7,930,176 B2 * 4/2011 Chen ..... 704/228
8,000,960 B2 * 8/2011 Chen et al. ..... 704/219
2004/0250195 A1 12/2004 Toriumi
2005/0091048 A1 4/2005 Thyssen et al.
2005/0246164 A1 * 11/2005 Ojala et al. ..... 704/205
2006/0171373 A1 * 8/2006 Li ..... 370/352
2006/0209955 A1 * 9/2006 Florencio et al. ..... 375/240.12

(Continued)

FOREIGN PATENT DOCUMENTS

CN 1445941 A 10/2003
CN 1573929 A 2/2005
CN 1930607 A 3/2007

(Continued)

OTHER PUBLICATIONS

Valenzuela et al., "A New Voice-Packet Reconstruction Technique," IEEE ICASSP-89, 2: 1334-1336 (1989).

(Continued)

*Primary Examiner* — Richemond Dorvil
*Assistant Examiner* — Michael Ortiz Sanchez
(74) *Attorney, Agent, or Firm* — Leydig, Voit & Mayer, Ltd.

(57) ABSTRACT

A device for lost frame concealment comprises: a lost frame detector for detecting whether a voice frame is lost, a decoding module for decoding the current voice frame, a low band delay module for delaying the low band signal, a low band signal recovering module for recovering the lost low band signal, a high band lost frame concealment module for processing the lost frame concealment for the high band signal, and a QMF synthesis filter for synthetically filtering the low band signal and the high band signal. The invention makes full use of the delay of the coding/decoding device itself, enhances the effect of lost frame concealment for the low band signal and the high band signal, and introduces no nearby delay during the process of lost frame concealment.

15 Claims, 12 Drawing Sheets

U.S. PATENT DOCUMENTS

| | | | | |
|---|---|---|---|---|
| 2006/0265216 | A1* | 11/2006 | Chen | 704/228 |
| 2006/0271354 | A1* | 11/2006 | Sun et al. | 704/205 |
| 2007/0198254 | A1* | 8/2007 | Goto et al. | 704/226 |
| 2008/0027711 | A1* | 1/2008 | Rajendran et al. | 704/201 |
| 2008/0046233 | A1* | 2/2008 | Chen et al. | 704/211 |
| 2008/0046236 | A1* | 2/2008 | Thyssen et al. | 704/228 |
| 2008/0046237 | A1* | 2/2008 | Zopf et al. | 704/228 |

FOREIGN PATENT DOCUMENTS

| | | | |
|---|---|---|---|
| EP | 1 526 507 | | 4/2005 |
| EP | 1684267 | A2 | 7/2006 |
| KR | 20070055943 | A | 5/2007 |
| WO | WO 02/058052 | A1 | 7/2002 |
| WO | WO 2007051124 | A1 | 5/2007 |

OTHER PUBLICATIONS

Extended European Search Report in corresponding European Application No. 08757725.0 (May 20, 2010).

Written Opinion of the International Searching Authority in corresponding PCT Application No. PCT/CN2008/071314 (Aug. 28, 2008).

"G.722—7 kHz audio0coding within 64 kbit/s, Appendix IV: A low-complexity algorithm for packet loss concealment with G.722," Series G: Transmission Systems and Media, Digital Systems and Networks; Digital terminal equipments—Coding of analogue signals by methods other than PCM, Nov. 2006, International Telecommunication Union, Geneva, Switzerland.

Hiwasako et al., "Embedded Wideband Speech Coding for VolP Conferences," IEICE Trans. Inf. & Syst., Sep. 2006, vol. E89-D, No. 9, Institute of Electronics, Information and Communication Engineers, Musashino, Japan.

Mori et al., "Wideband Speech Coding Robust against Packet Loss," Electronics and Communications in Japan, 2006, Part 3, vol. 89, No. 12, Wiley Periodicals, Inc., Musashino, Japan.

* cited by examiner

METHOD OF LOST FRAME CONCEALMENT AND DEVICE

CROSS-REFERENCE TO RELATED APPLICATIONS

This application is a continuation of International Patent Application No. PCT/CN2008/071314, filed Jun. 13, 2008, which claims priority to Chinese Patent Application No. 200710074989.0, filed Jun. 15, 2007, both of which are hereby incorporated by reference in their entireties.

FIELD OF THE INVENTION

The present invention relates to the field of lost frame concealment, and in particular, to a method of lost frame concealment for a voice or audio encoder and a device.

BACKGROUND

The packet technology is widely used in network communication. With the packet technology, various encoded information, such as voice, image, and data, is transmitted on a network. Due to the restriction on the transmitting capacity at the transmitting end, or during a specified delay period, a packet information frame does not arrive at the buffer of the receiving end, and thus information is lost. This is a common scenario for lost frame. Moreover, a frame may be lost due to network congestion or transmission loss on a packet switching network.

At present, different lost frame concealment technologies comply with diversified voice encoding standards and are used to compensate loss of voice quality due to lost frames. An algorithm for lost frame concealment is embedded in some voice decoders based on code excitation linear prediction.

The existing waveform encoding technology provides an algorithm for lost frame concealment. This algorithm, however, can be used for only 8 kHz sampling narrowband signals instead of broadband signals, and cannot meet the requirements for high-quality calls.

SUMMARY

In view of the preceding problems in the existing technology, a method for lost frame concealment and a device supporting band expansion are provided herein to implement lost frame concealment processing of broadband information and meet the requirements for high-quality calls.

The solution provided in an embodiment of the present invention is as follows:

A device that implements lost frame concealment is provided in an embodiment of the present invention. The device includes: (1) a lost frame detector, adapted to: receive voice data, detect whether a voice frame is lost, and generate the frame loss information; (2) a decoding module, adapted to: decode the received current voice frame and generate a low band signal and a high band decoded signal of the current frame; (3) a low band delay module, adapted to: set the delay time for the low band signal of the current frame and generate a low band decoded signal of the previous frame; (4) a low band signal recovering module, adapted to recover the lost low band decoded signal of the previous frame when the frame loss information shows that the previous frame is lost; (5) a high band lost frame concealment module, adapted to: receive the high band decoded signal of the current frame and the frame loss information and generate a high band decoded signal of the previous frame; and (6) a Quadrature Mirror Filter (QMF) synthesis filter, adapted to: receive a low band decoded signal of the previous frame generated by a low band delay module and a high band decoded signal of the previous frame generated by a high band lost frame concealment module, synthetically filter the low band signal and high band signal, and output a previous frame voice signal; or, receive a low band decoded signal of the previous frame recovered by a low band signal recovering module and a high band decoded signal of the previous frame generated by a high band lost frame concealment module, synthetically filter the low band signal and high band signal, and output a previous frame voice signal.

A method for lost frame concealment is provided in an embodiment of the present invention. The method includes: (1) detecting whether a voice frame is lost, and generating the frame loss information; (2) decoding the current frame if the current frame is not lost, and generating a current frame low band decoded signal and a high band decoded signal of the current frame; (3) setting the delay time for the current frame low band signal, and generating a low band decoded signal of the previous frame; or recovering the lost low band decoded signal of the previous frame when the frame loss information shows that the previous frame is lost; (4) processing the high band decoded signal of the current frame according to the frame loss information, and generating a high band decoded signal of the previous frame; and (5) synthetically filtering the low band decoded signal of the previous frame and the high band decoded signal of the previous frame, and generating a previous frame voice signal.

The device and method for lost frame concealment that are provided in an embodiment of the present invention make use of the delay of the coding/decoding device itself, enhance the effect of lost frame concealment for the low band signal and the high band signal, and introduce no nearby delay during the process of lost frame concealment.

BRIEF DESCRIPTION OF THE DRAWINGS

The present invention is described in detail in concrete implementing mode and in combination with the drawings.

DETAILED DESCRIPTION

Figure 1:
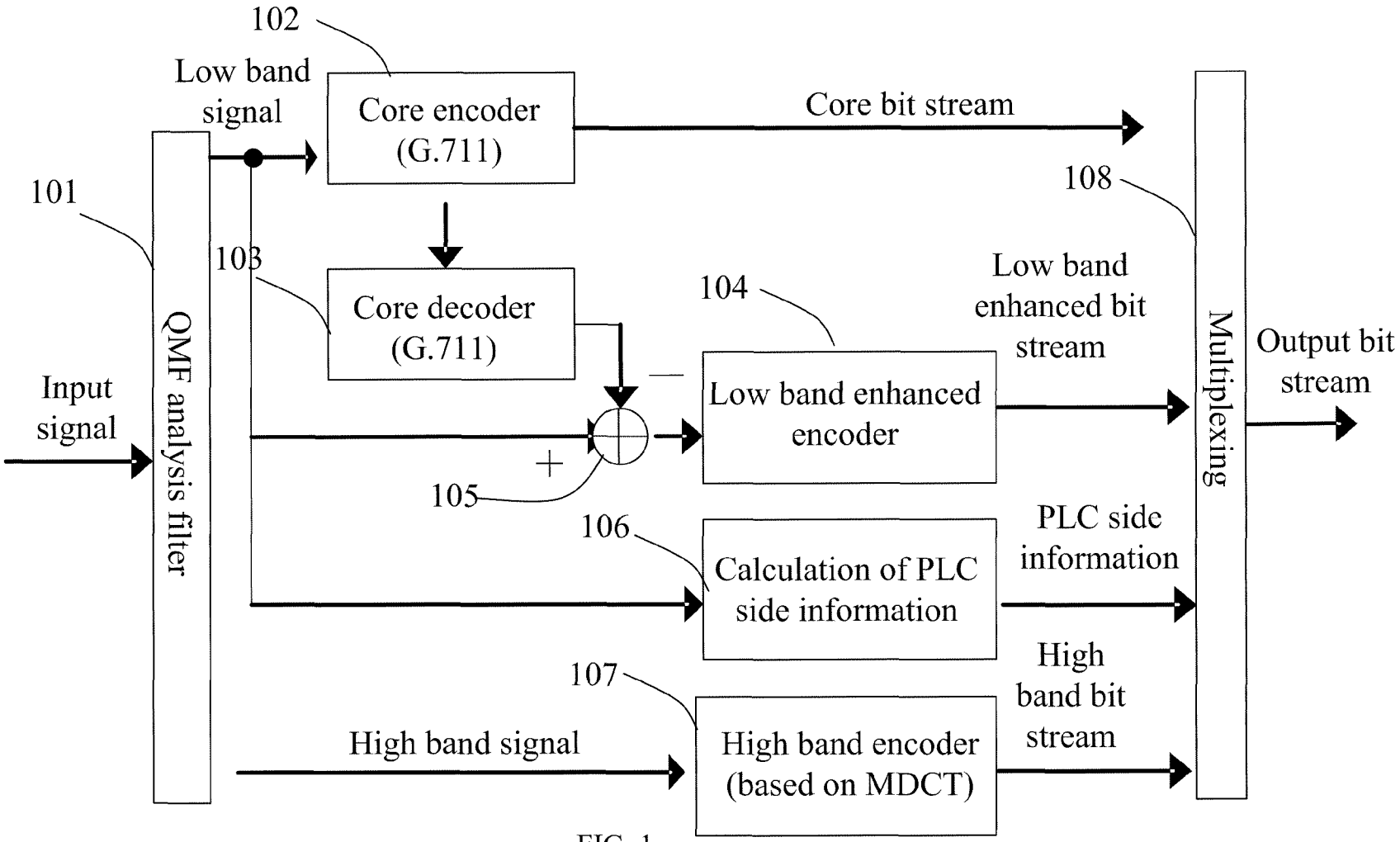
FIG. 1 is a block diagram of a G.711 broadband expansion encoder.

FIG. 1 is a block diagram of a broadband expansion encoder. A G.711 broadband expansion encoder is taken as an example. In FIG. 1, the QMF analysis filter 101 receives an input signal of 16 kHz sampling, analyzes and filters the signal, and then output a low band signal of 8 kHz sampling and a high band signal of 8 kHz sampling. The low band signal is output to the core encoder 102, that is, a G.711 encoder. After the signal is encoded, the core bit stream is output to the multiplexing module 108. The core bit stream is also output from the core encoder 102 to the core decoder 103, that is, a G.711 decoder. After the stream is decoded, a low band signal is output to the adder 105. The low band signal is also output from the QMF analysis filter 101 to the adder 105. A residual signal is output from the adder to the low band enhanced encoder 104. The low band enhanced encoder 104 encodes the input low band residual signal, and outputs a low band enhanced bit stream to the multiplexing module 108. The low band signal is also output from the QMF analysis filter 101 to the packet loss concealment (PLC) side information calculation module 106. The module is used to calculate the auxiliary information about lost frame concealment, whose concept is similar to the PLC concept and can be replaced by the PLC concept unless noted otherwise in an embodiment of the present invention. The lost frame concealment performance at the decoding end is improved on the basis of the auxiliary information. The PLC side information calculation module 106 outputs the PLC side information to the multiplexing module 108. The high band signal is output from the QMF analysis filter 101 to the high band encoder 107. After the signal is encoded, the high band bit stream is output to the multiplexing module 108. The high band encoder 107 is based on MDCT.

Figure 2:
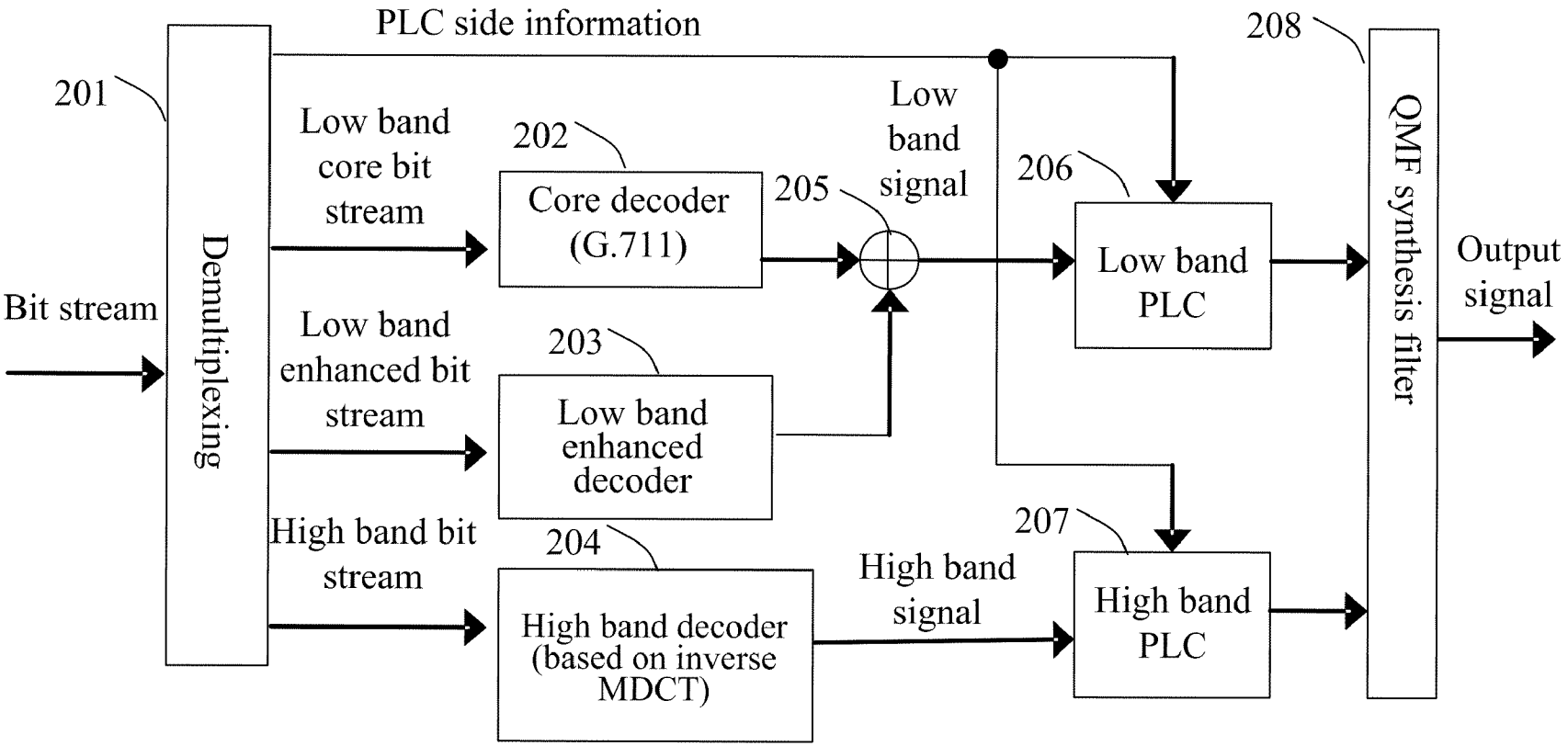
FIG. 2 is a block diagram of a G.711 broadband expansion decoder.

FIG. 2 is a block diagram of a broadband expansion decoder. A G.711 broadband expansion decoder is still taken as an example. In FIG. 2, the demultiplexing module 201 receives the bit stream, demultiplexes the bit stream, and then outputs the PLC side information, low band core bit stream, low band enhanced bit stream, and high band bit stream. The core decoder 202, that is, the G.711 decoder, receives the low band core bit stream, decodes the bit stream, and then outputs the bit stream to the adder 205. The low band enhanced 203 receives the low band enhanced bit stream, decodes the bit stream, and then outputs the bit stream to the adder 205. The adder 205 adds two input signals, generates a low band signal, and outputs the low band signal to the low band PLC module 206. The low band PLC module 206 performs lost frame concealment processing, and then outputs a signal to the QMF synthesis filter module 208. The high band decoder 204 based on the inverse transformation of MDCT receives the high band bit stream, decodes the bit stream, and outputs a high band signal to the high band PLC module 207. The high band PLC module 207 performs lost frame concealment processing in the high band, and then outputs a signal to the QMF synthesis filter module 208. The QMF synthesis filter module 208 synthetically filters the low band signal and high band signal that lost frame concealment processing is performed, and then a 16 kHz sampling signal is output.

The high band encoder 107 shown in FIG. 1 is based on forward MDCT. The high band decoder 204 shown in FIG. 2 is based on inverse MDCT. Because the MDCT is closely related to an embodiment of the present invention, the MDCT is described herein.

The MDCT reduces the boundary effect with the aliasing cancellation technology in the time domain. The formulas of forward MDCT and inverse MDCT are as follows:

$$X(k) = \sum_{n=0}^{2N-1} h(n)x(n)\cos\left[\frac{(2k+1)\pi}{2N}(n+n_0)\right]$$

$$X(n) = \frac{2}{N}h(n)\sum_{k=0}^{N-1} X(k)\cos\left[\frac{(2k+1)\pi}{2N}(n+n_0)\right]$$

N represents the size of a frame; k=0, 1, . . . , N−1; n=0, 1, . . . , 2N−1; $n_0$=N/2+½; x(n) represents a time domain signal; X (k) represents a frequency domain signal after forward MDCT; X(n) represents a signal after inverse MDCT; h(n) represents a window function. The preceding parameters have the following relationship:

$$h(n)h(n)+h(n+N)h(n+N)=1$$

$$h(n)=h(2N-1-n)$$

The reconstructed time domain signal x(n) is calculated with the following formula:

$$\hat{x}(n)=X_p(n+N)+X(n)\ n=0, 1, \ldots N-1$$

In the formula, $X_p$(n+N) represents the previous frame signal after inverse MDCT.

Figure 3:
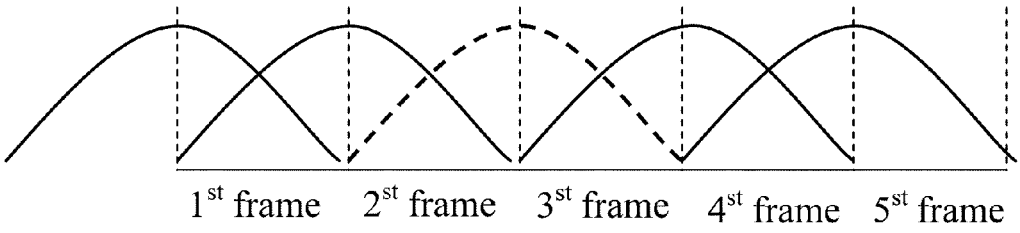
FIG. 3 shows a Modified Discrete Cosine Transform (MDCT) superposed window.
Figure 4:
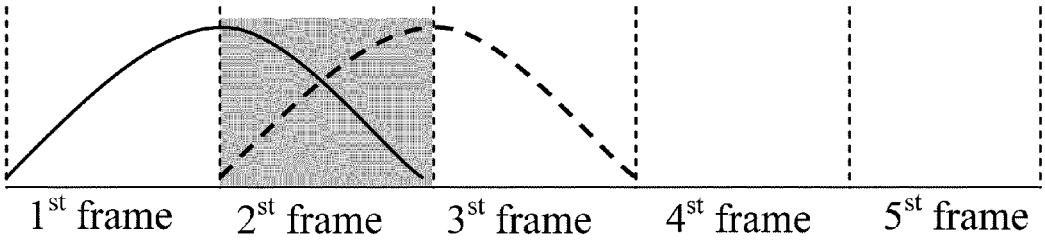
FIG. 4 shows a frame delay that is introduced by MDCT.

The MDCT provided in an embodiment of the present invention is described below. For example, for encoding the 3rd high band signal shown in FIG. 3, the high band encoder 107 shown in FIG. 1 first selects 2N samples, which are composed of N samples of previous frame (that is, the 2nd frame) and N samples of the current frame (that is, the 3rd frame) that are provided in embodiments of the present invention, and then multiplies 2N by a window parameter represented by the dotted line in FIG. 3 to perform forward MDCT. After the MDCT time domain signal after MDCT is encoded in a certain mode, such as Huffman encoding, the high band bit stream is produced. At the decoding end, the high band decoder 204 shown in FIG. 2 decodes the high band bit stream of the 3rd frame to obtain an MDCT time domain signal. After inverse MDCT is performed, a signal is obtained. After the second semi-window signal of the 2nd frame after inverse MDCT and the first semi-window signal of the 3rd frame after inverse MDCT are superposed, the reconstructed 2nd high band signal is output, as shown in the shaded area in FIG. 4. FIG. 4 shows that MDCT introduces an additional one frame delay to the encoder/decoder.

Figure 5A:
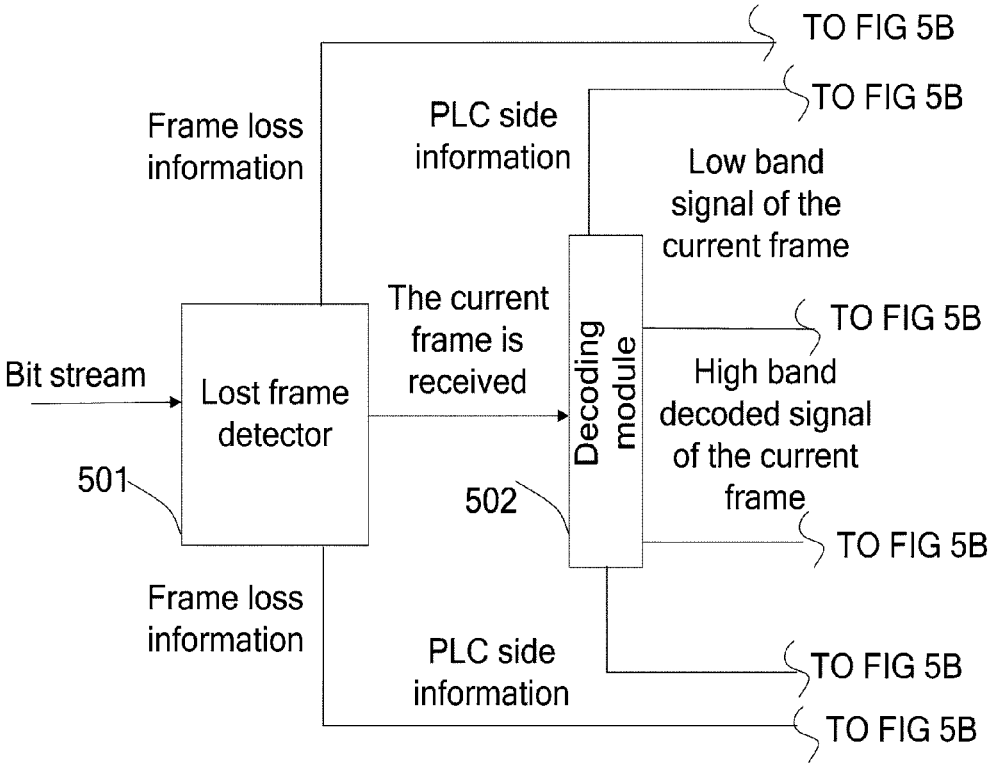
FIGS. 5A and 5B are block diagrams of a device for lost frame concealment according to an embodiment of the present invention.
Figure 5B:
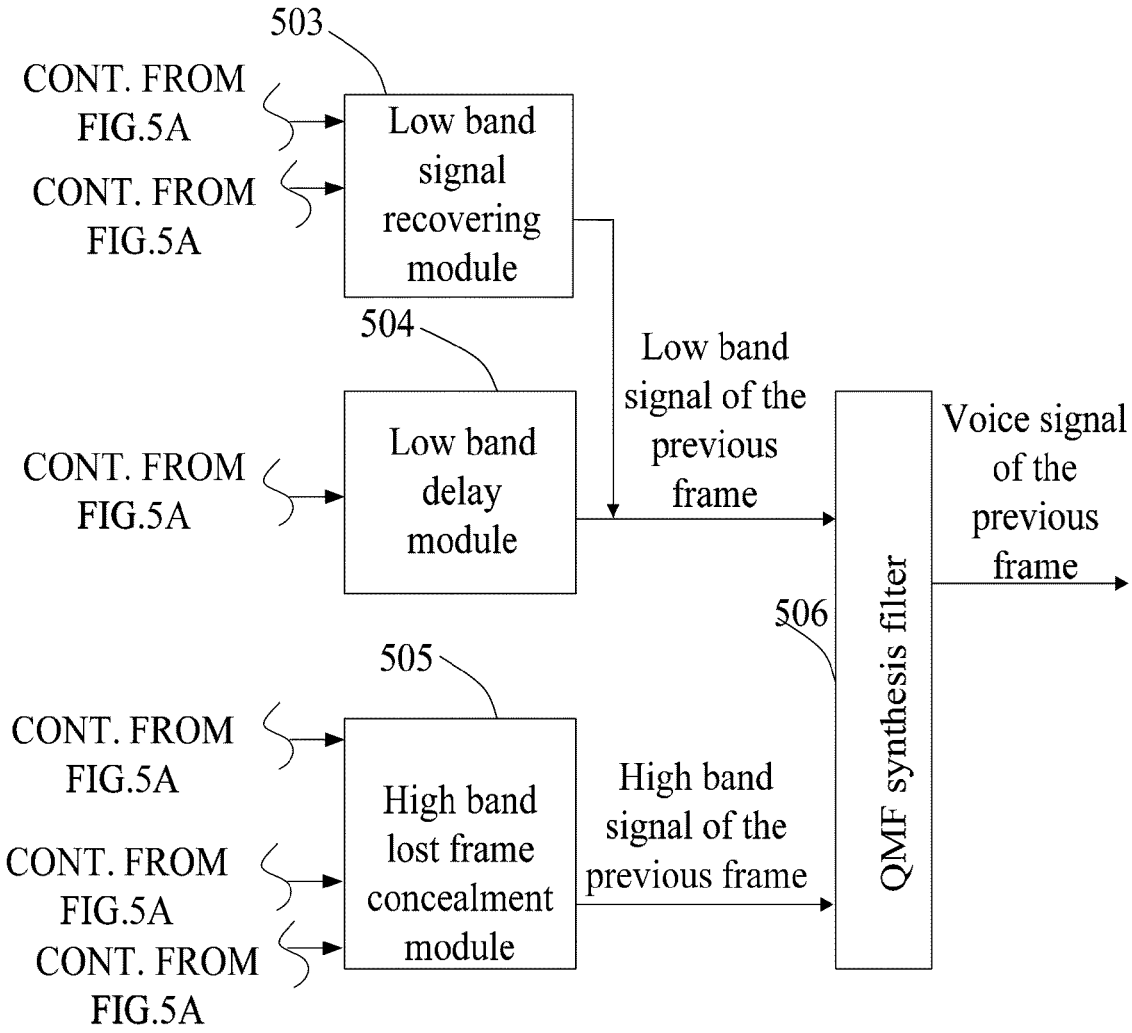

FIG. 5 is a block diagram of a lost frame concealment method provided in an embodiment of the present invention. The lost frame detector 501 receives the bit stream, detects whether a voice frame or an IP package is lost, and records the loss status. In an embodiment of the present invention, suppose that an IP package contains only the code stream of a voice frame. Therefore, the concept of a package loss is equivalent to the concept of frame loss. If the current frame is received, the decoding module 502 decodes the current frame, and outputs the low band signal of the current frame, high band decoded signal of the current frame, and PLC side information. The decoding module 502 corresponds to the demultiplexing module 201, core decoder 202, low band enhanced decoder 203, high band decoder 204, and adder 205 in FIG. 2. The decoding module 502 outputs a low band signal to the low band delay module 504. The low band delay module 504 delays a frame size, and then outputs a low band signal of the previous frame to the QMF synthesis filter 506. The QMF synthesis filter 506 corresponds to the QMF synthesis filter 208 in FIG. 2. The lost frame detector 501 outputs the relevant frame loss information to the low band signal recovering module 503. If the previous frame is lost, the low band signal recovering module 503 uses a low band lost frame concealment algorithm to recover a low band signal of the previous frame. The low band signal recovering module 503 also receives the PLC side information output by the decoding module 502, and improves the lost frame concealment performance based on the PLC side information. Such improving is not necessary. Because the low band signal recovering module 503 recovers a low band signal of the previous frame after delaying a frame, the effect of recovering the low band signal of the previous frame can be enhanced on the basis of the received information about the current frame. The low band signal recovering module 503 outputs a low band signal of the previous frame to the QMF synthesis filter 506. The QMF synthesis filter 506 can receive a low band signal of the previous frame no matter whether the previous frame is lost or not because the QMF synthesis module 506 receives a low band signal of the previous frame from the low band delay module 504 when the previous frame is not lost. The high band lost frame concealment module 505 receives a high band decoded signal of the current frame and the PLC side information from the decoding module 502, and receives the frame loss information from the lost frame detector. After the high band lost frame concealment processing is performed, the high band lost frame concealment module 505 outputs a high band decoded signal of the previous frame to the QMF synthesis filter 506. FIG. 4 shows that: When the decoding module 502 outputs a high band decoded signal of the current frame that is produced after inverse MDCT, the length of the signal is two frames. The high band lost frame concealment module 505, however, outputs a high band decoded signal of the previous frame whose length is only one frame. The one frame is produced by superposing the second semi-window signal of previous frame after MDCT and the first semi-window signal of current frame, or is recovered with a lost frame concealment method when a signal after inverse MDCT is lost. The QMF synthesis filter 506 synthetically filters the received low band decoded signal of the previous frame and high band decoded signal of the previous frame, and outputs a voice signal of 16 kHz sampling of the previous frame.

With the existing technology, the information about next frame of the lost frame is not used to recover the lost frame in the lost frame concealment solution, and an additional 3.75 ms delay is introduced. In the PLC solution as shown in FIG. 5 according to an embodiment of the present invention, one frame delay of the MDCT itself is fully used. The information about next frame of a lost frame can be used to recover a lost low band signal and recover a high band second semi-window signal, and no additional delay is introduced during the process of lost frame concealment.

Figure 6:
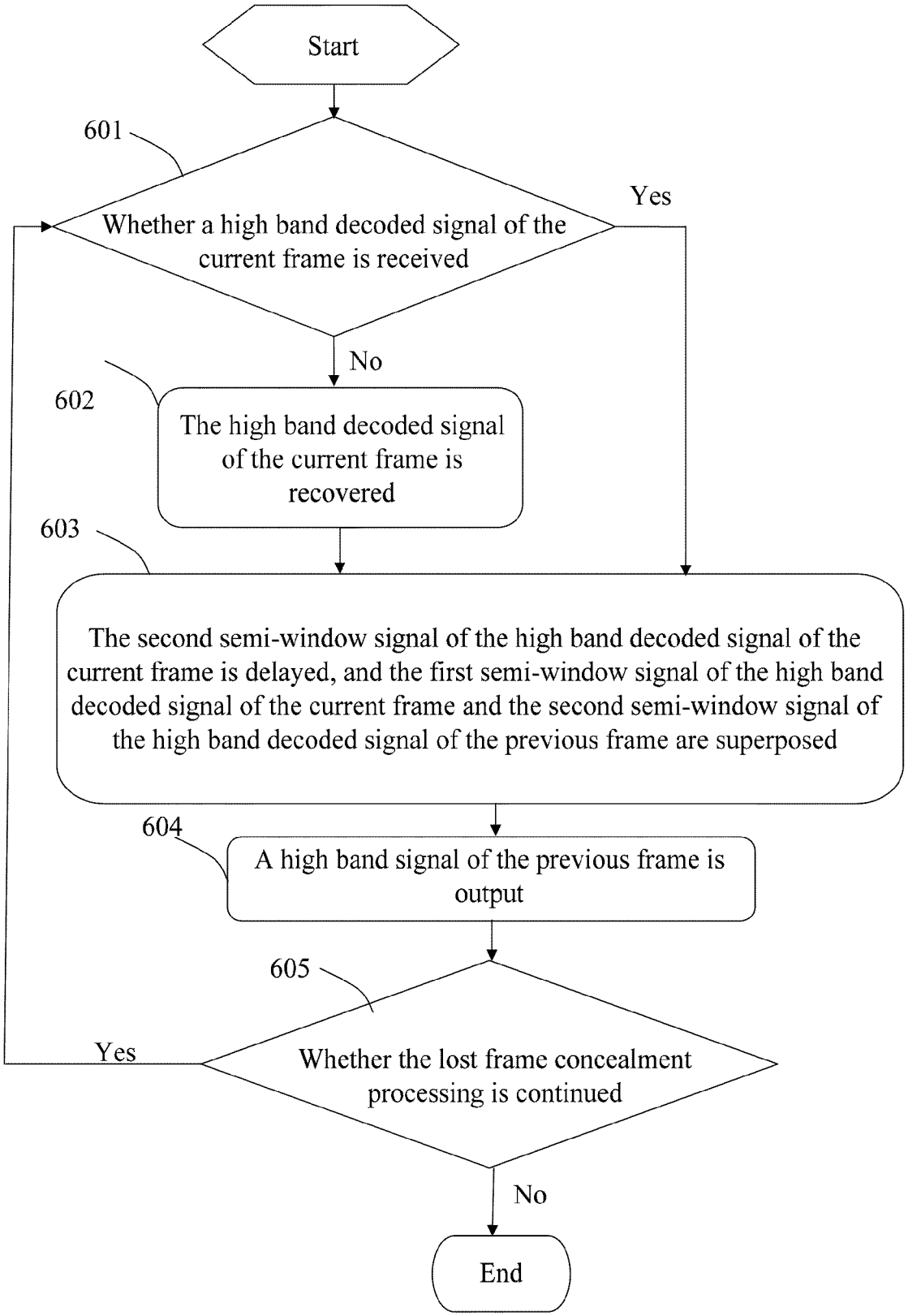
FIG. 6 is a flowchart of implementing lost frame concealment by a high band lost frame concealment module according to an embodiment of the present invention.

FIG. 6 shows an embodiment of the high band lost frame concealment module 505 shown in FIG. 5. In step 601, a judgment is made about whether a high band decoded signal of the current frame is received on the basis of the frame loss information that is output by the lost frame detector shown in FIG. 5. If the signal is received, the process proceeds to step 603; otherwise, the process proceeds to step 602. In step 602, a lost high band decoded signal of the current frame is recovered with the lost frame concealment algorithm. After the handling, the process proceeds to step 603. As mentioned earlier, the length of a recovered high band decoded signal of the current frame is two frames. In the high band decoded signal, the first semi-window signal is located in the first half part and the second semi-window signal is located in the second half part. In step 603, the time of a frame in the second semi-window signal of the high band decoded signal of the current frame is delayed, and the first semi-window signal of high band decoded signal of the current frame and the second semi-window signal of previous frame high band decoded signal are superposed to produce a high band decoded signal of the previous frame. In step 604. the high band decoded signal of the previous frame produced in step 603 is output. In step 605, a judgment is made about whether to continue the lost frame concealment processing. If yes, the process proceeds to step 601; otherwise, the process is complete.

The high band lost frame concealment algorithm shown in FIG. 6 suffers no substantial change after the sequence of some steps is adjusted. For example, the operation of delaying the second semi-window signal of high band decoded signal of the current frame in step 603 is performed after step 604. Therefore, such adjustment shall be considered as falling in the scope of the present invention.

A high band signal is similar to noise, and not sensitive to phrase. The signal can be recovered as long as the high signal that is recovered with the lost frame concealment algorithm has the similar characteristics, such as energy and zero-over rate showing the feature of a frequency domain, with the original high band signal. Because the characteristics, such as energy and zero-over rate, of two adjacent frame high band signals are not changed greatly, the currently lost high band signal can be replaced with a high band decoded signal of the previous frame. Based on the preceding theory, an effective implementation method in step 602 can be used: Copy a previous frame high band decoded signal as the currently lost high band decoded signal. The previous frame high band decoded signal can be the signal output by the decoding module 502 in FIG. 5 when the previous frame is received or the signal produced during the process of lost frame concealment when the previous frame is lost.

Figure 7A:
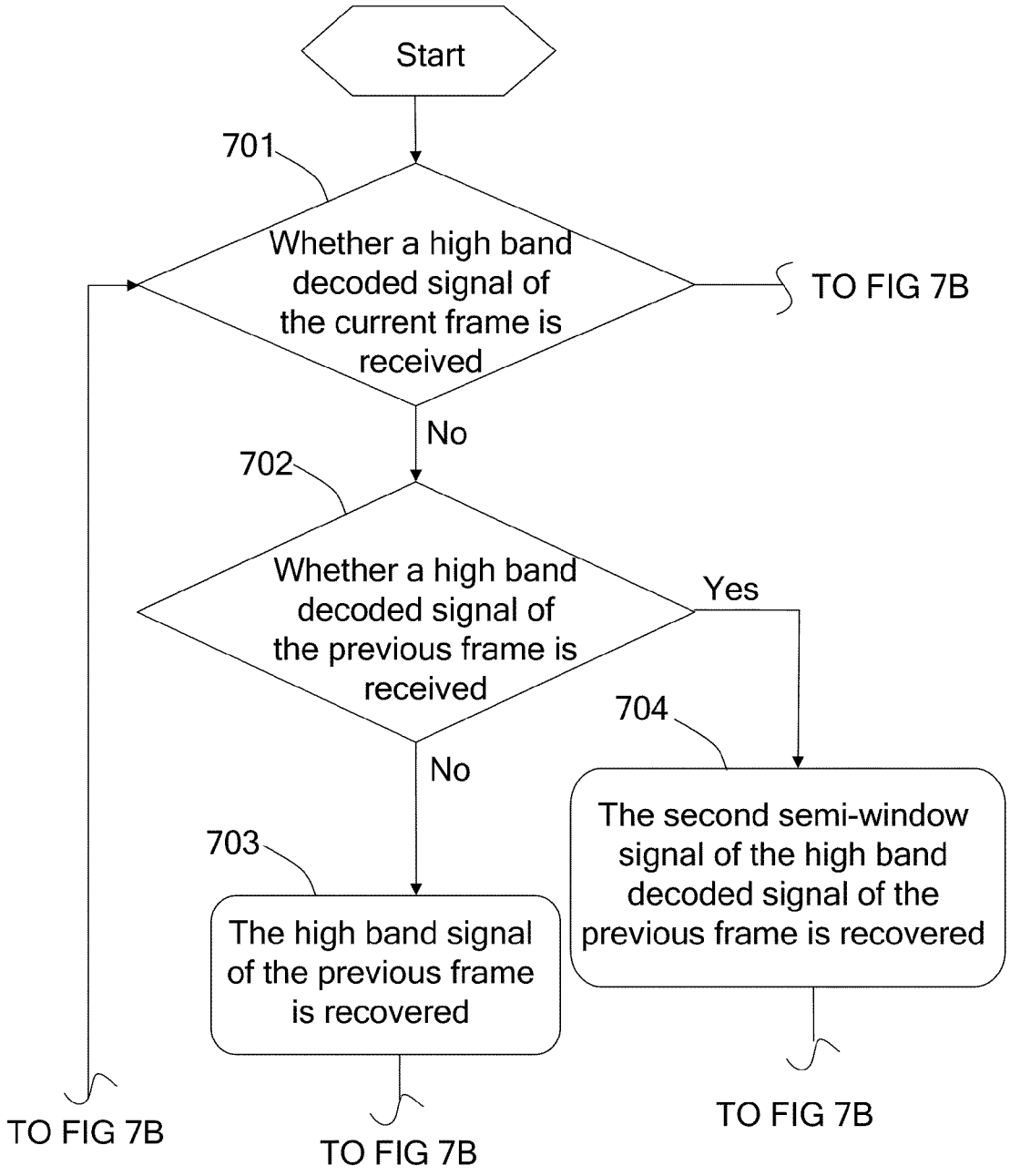
FIGS. 7A and 7B are flowcharts of implementing lost frame concealment by a high band lost frame concealment module according to another embodiment of the present invention.
Figure 7B:
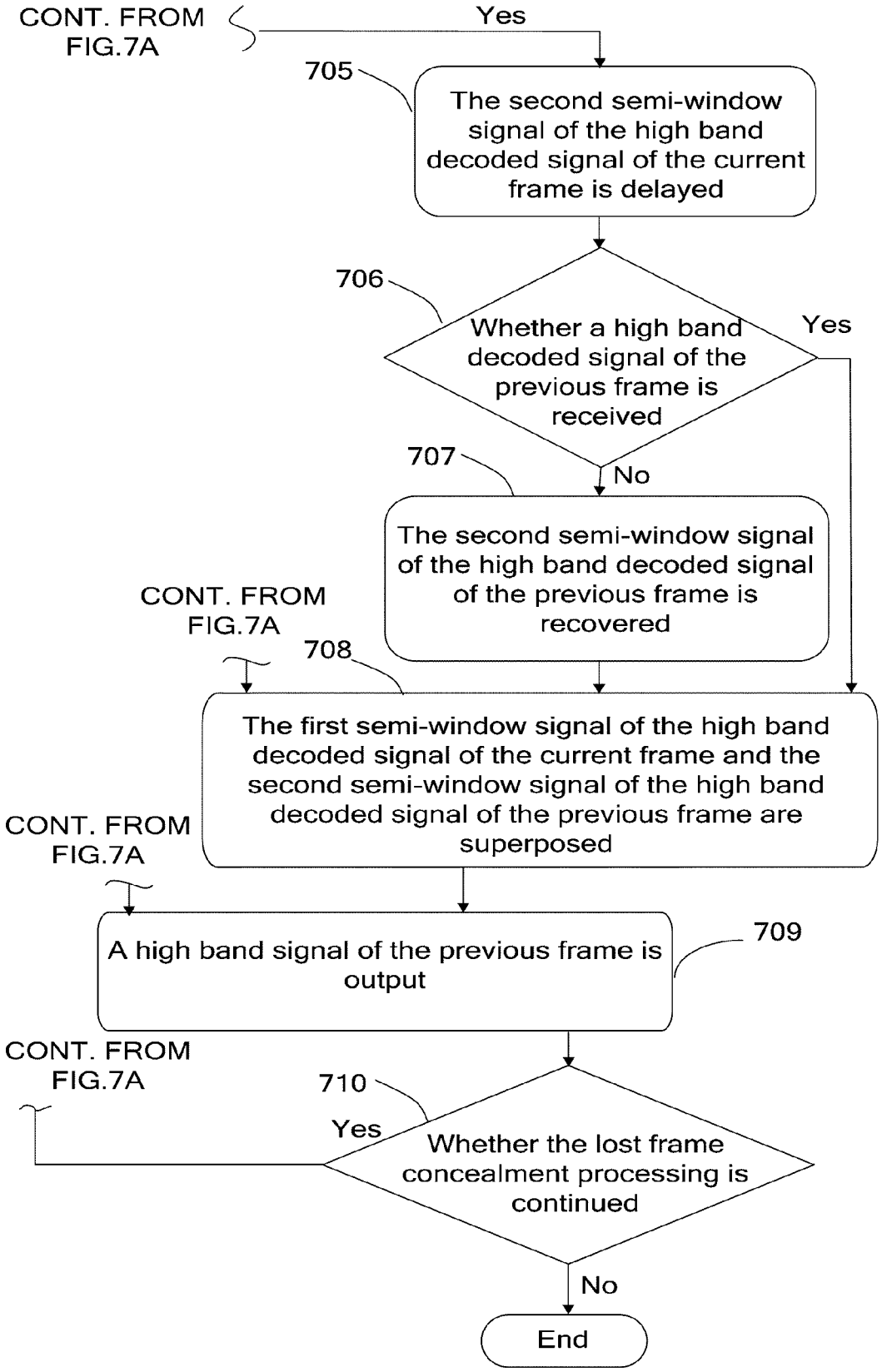

FIG. 7 shows another embodiment of the high band lost frame concealment module 505 shown in FIG. 5. In step 701, a judgment is made about whether a high band decoded signal of the current frame is received on the basis of the frame loss information that is output by the lost frame detector shown in FIG. 5. If the signal is received, the process proceeds to step 705; otherwise, the process proceeds to step 702. In step 702, a judgment is made about whether a previous frame high band decoded signal is received. If the signal is received, the process proceeds to step 704; otherwise, the process proceeds to step 703. In step 703, a high band decoded signal of the previous frame is recovered. After the handling, the process proceeds to step 709. In step 704, the first semi-window signal of the high band decoded signal of the current frame is recovered. After the handling, the process proceeds to step 708. In step 705, the second semi-window signal of high band decoded signal of the current frame is delayed. After the handling, the process proceeds to step 706. In step 706, a judgment is made about whether a previous frame high band decoded signal is received. If the signal is received, the process proceeds to step 708; otherwise, the process proceeds to step 707. In step 707, the second semi-window signal of previous frame high band decoded signal is recovered. After the handling, the process proceeds to step 708. In step 708, the first semi-window signal of high band decoded signal of the current frame and the second semi-window signal of previous frame high band decoded signal are superposed to produce a high band decoded signal of the previous frame. After the handling is complete in step 708, the process proceeds to step 709. In step 709, a high band decoded signal of the previous frame is output. In step 710, a judgment is made about whether to continue the lost frame concealment processing. If yes, the process proceeds to step 701; otherwise, the process is complete.

The high band lost frame concealment algorithm shown in FIG. 7 suffers no substantial change after the sequence of some steps is adjusted. For example, the operation of delaying the second semi-window signal of high band decoded signal of the current frame in step 703 is performed after step 706, 707, 708 or 709. Therefore, such adjustment shall be considered as falling in the scope of the present invention.

Figure 8A:
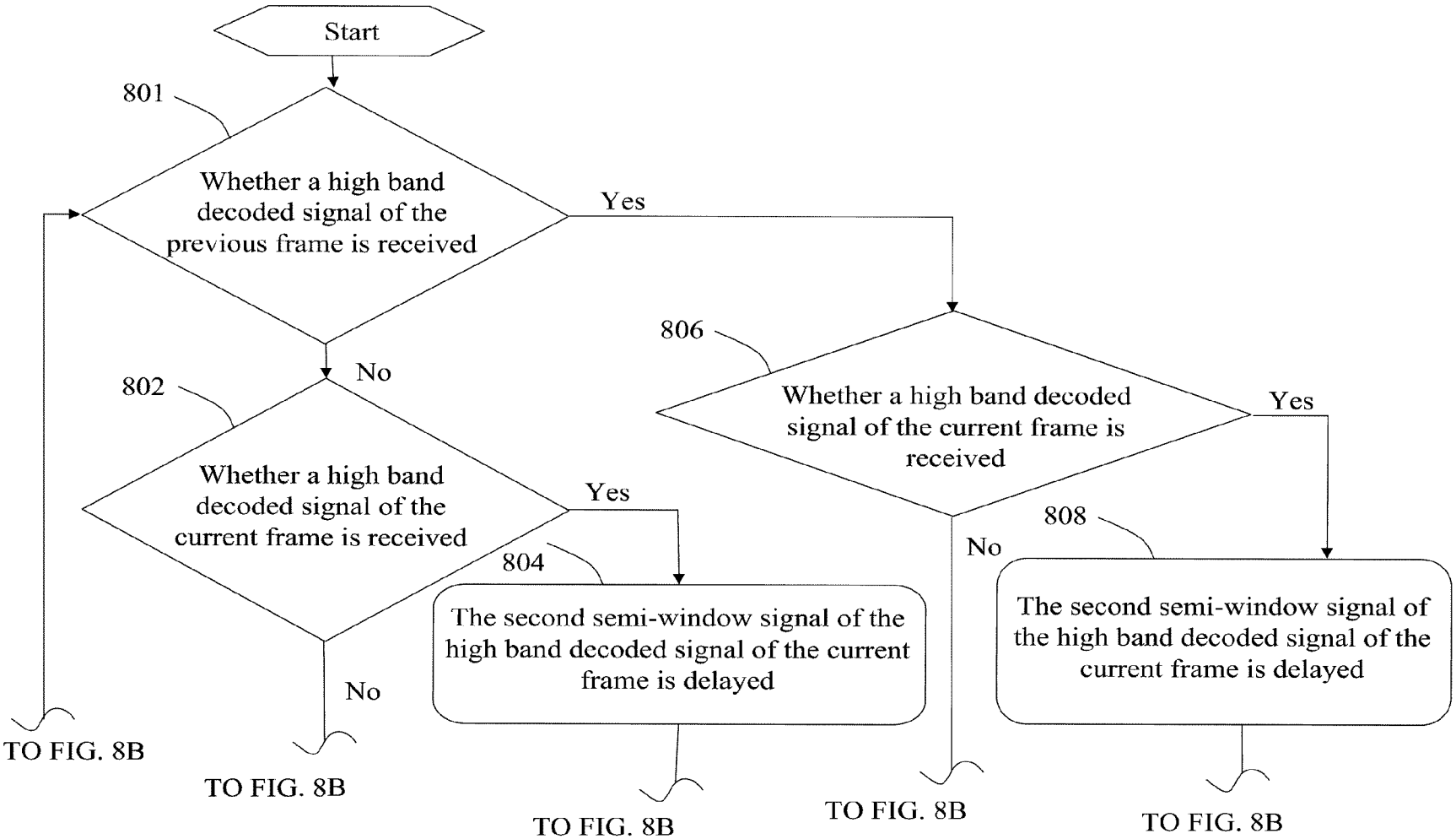
FIGS. 8A and 8B are changed flowcharts of FIGS. 7A and 7B.
Figure 8B:
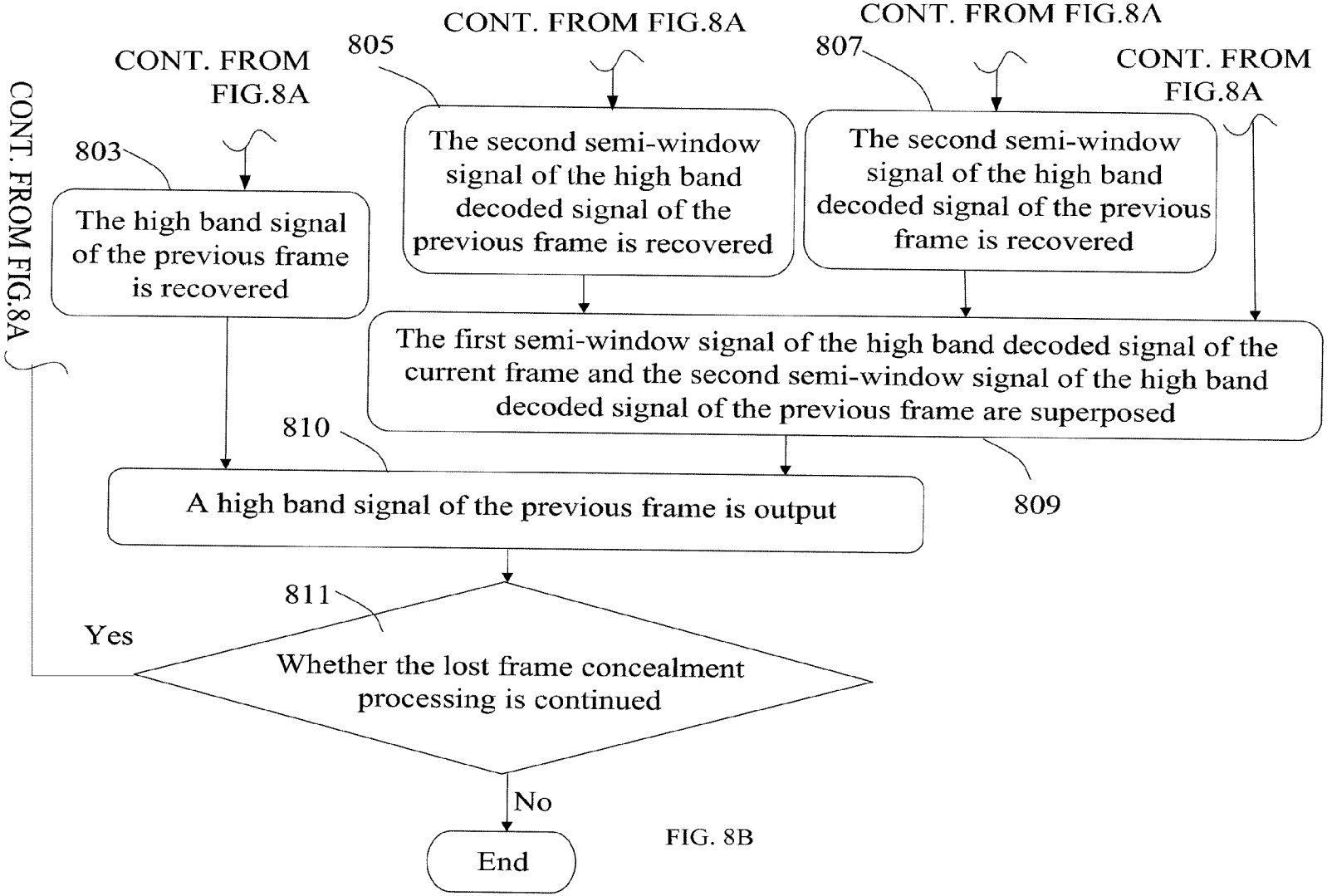

FIG. 8 is a changed flowchart of FIG. 7. The basic concepts of both figures are the same. The sequence, however, for judging whether the current frame and the previous frame are received is different. In step 801, a judgment is made about whether a previous frame high band decoded signal is received on the basis of the frame loss information that is output by the lost frame detector shown in FIG. 5. If the signal is received, the process proceeds to step 806; otherwise, the process proceeds to step 802. In step 802, a judgment is made about whether a high band decoded signal of the current frame is received. If the signal is received, the process proceeds to step 804; otherwise, the process proceeds to step 803. In step 803, a high band decoded signal of the previous frame is recovered. After the handling, the process proceeds to step 810. In step 804, the second semi-window signal of high band decoded signal of the current frame is delayed. After the handling, the process proceeds to step 805. In step 805, the second semi-window signal of previous frame high band decoded signal is recovered. After the handling, the process proceeds to step 809. In step 806, a judgment is made about whether a high band decoded signal of the current frame is received. If the signal is received, the process proceeds to step 808; otherwise, the process proceeds to step 807. In step 808, the second semi-window signal of high band decoded signal of the current frame is delayed. After the handling, the process proceeds to step 809. In step 807, the first semi-window signal of high band decoded signal of the current frame is recovered. After the handling, the process proceeds to step 809. In step 809, the first semi-window signal of high band decoded signal of the current frame and the second semi-window signal of previous frame high band decoded signal are superposed to produce a high band decoded signal of the previous frame. After the handling is complete in step 809, the process proceeds to step 810. In step 810, a high band decoded signal of the previous frame is output. In step 911, a judgment is made about whether to continue the lost frame concealment processing. If yes, the process proceeds to step 801; otherwise, the process is complete.

The high band lost frame concealment algorithm shown in FIG. 8 suffers no substantial change after the sequence of some steps is adjusted. For example, the operation of delaying the second semi-window signal of high band decoded signal of the current frame in step 805 and step 808 is moved after step 809 or 810. Therefore, such adjustment shall be considered as falling in the scope of the present invention.

In FIG. 6, a high band decoded signal of the current frame including the first semi-window signal and second semi-window signal is recovered immediately when the current frame is lost. In FIG. 8 and FIG. 7, only the first semi-window signal of high band decoded signal of the current frame is recovered immediately when the current frame is lost, and the second semi-window signal is recovered after a frame is delayed, that is the process of recovering the second semi-window signal of previous frame high band decoded signal in step 707 as shown in FIG. 7 and step 805 as shown in FIG. 8. Compared with FIG. 6, FIG. 8 and FIG. 7 have the following advantage: The information about the current frame can be used to recover the second semi-window signal of previous frame high band decoded signal, thus easily improving the effect of lost frame concealment.

In step 704 as shown in FIG. 7 and step 807 as shown in FIG. 8, many methods can be used to recover the first semi-window signal of high band decoded signal of the current frame. Two methods are described as follows:

Method 1: The first semi-window signal of high band decoded signal of the current frame is set to zero. In this case, step 708 as shown in FIG. 7 and step 809 as shown in FIG. 8 may be omitted, that is, the second semi-window signal of previous frame high band decoded signal serves as a high band decoded signal of the previous frame directly.

Method 2: The first semi-window signal of previous frame high band decoded signal is copied and serves as the first semi-window signal of high band decoded signal of the current frame. Compared with method 1, method 2 has the advantage of keeping the continuity of energy.

In step 707 as shown in FIG. 7 and step 805 as shown in FIG. 8, many methods can be used to recover the second semi-window signal of previous frame high band decoded signal. Four methods are described as follows:

Method 1: The second semi-window signal of previous frame high band decoded signal is set to zero. In this case, step 708 in FIG. 7 and step 809 in FIG. 8 may be omitted, that is, the first semi-window signal of high band decoded signal of the current frame serves as a high band decoded signal of the previous frame directly.

Method 2: The second semi-window signal of high band decoded signal of the frame before the previous frame is copied and serves as the second semi-window signal of previous frame high band decoded signal.

Method 2: The second semi-window signal of high band decoded signal of the current frame is copied and serves as the second semi-window signal of previous frame high band decoded signal.

Figure 9:
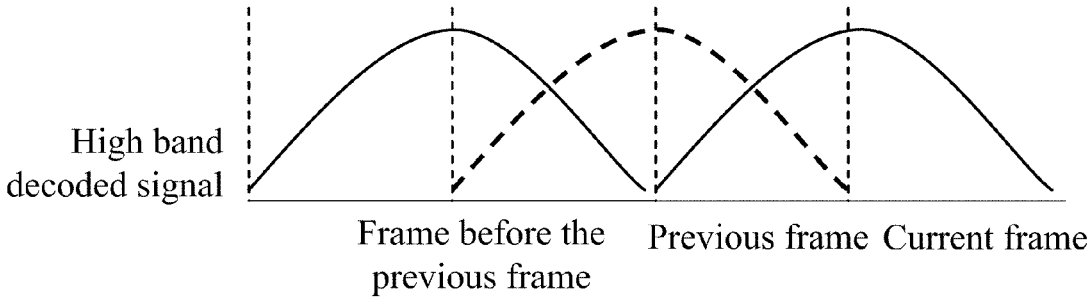
FIG. 9 shows a method for recovering the second semi-window signal of previous frame high band decoded signal that is shown in FIG. 7 and FIG. 8.

Method 4: As shown in FIG. 9, the second semi-window signal of high band decoded signal of the frame before the previous frame is multiplies by a descending window, and the first semi-window signal of high band decoded signal of the current frame is multiplies by an ascending window. The second semi-window signal and first semi-window signal are superposed to produce the second semi-window signal of previous frame high band decoded signal. The maximum linear of descending window is dropped from 1 to 0. The maximum linear of ascending window is raised from 0 to 1. A superposed window may be in other shape, such as a rectangular window with the maximum of 0.5. The advantage of the method is that the continuity of signal energy is kept when the second semi-window signal of high band decoded signal recovered on the basis of the information about the frames before and following the lost frame.

In step 703 as shown in FIG. 7 and step 803 as shown in FIG. 8, many methods can be used to recover a high band decoded signal of the previous frame. Two methods are described as follows:

Method 1: The first semi-window signal of high band decoded signal of the current frame and the second semi-window signal of previous frame high band decoded signal are recovered separately and then superposed to produce a high band decoded signal of the previous frame. The first semi-window signal of previous frame high band decoded signal can be copied to recover the first semi-window signal of high band decoded signal of the current frame. The second semi-window signal of high band decoded signal of the frame before the previous frame can be copied to recover the second semi-window signal of previous frame high band decoded signal.

Method 2: A high band signal of the frame before the previous frame is copied as a high band decoded signal of the previous frame.

The low band signal recovering module 503 in FIG. 5 performs the operation by repeating pitch, that is, the last pitch period in the previous frame of lost frame is filled repeatedly to the lost frame until a frame is produced. For example, in FIG. 10, the previous frame is lost and the last pitch period of the frame before the previous frame is P. First, the last pitch period of the frame before the previous frame is filled on the far left of the lost frame. Then, a pitch period is filled again. In this case, a frame is not filled completely. Suppose that the length of the frame is N, and the length that is to be filled is N−P×2. The N−P×2 samplings at the beginning of the pitch period are used to fill in the remaining space, and the filling operation is complete.

Figure 10:
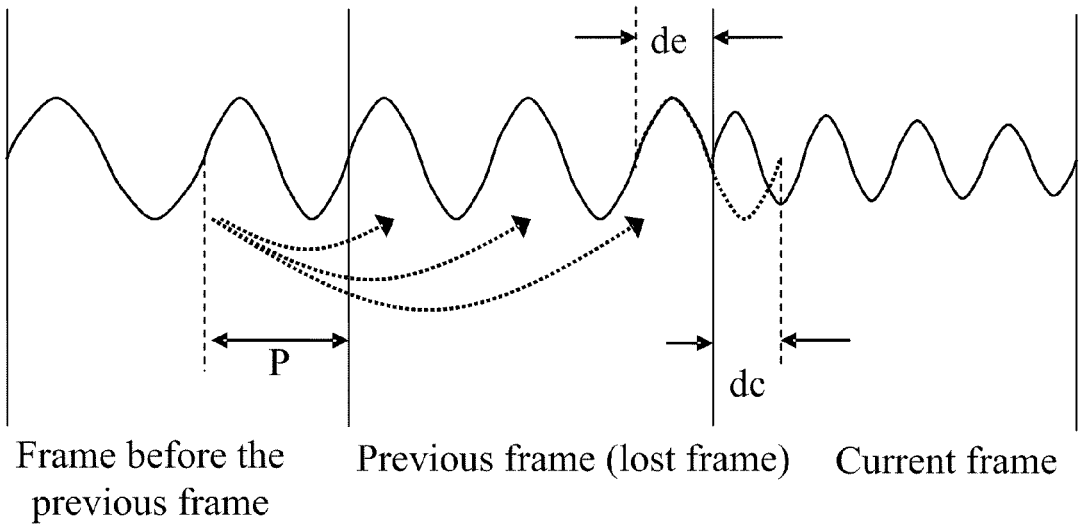
FIG. 10 shows mismatched lost frame concealment phases.
Figure 11:
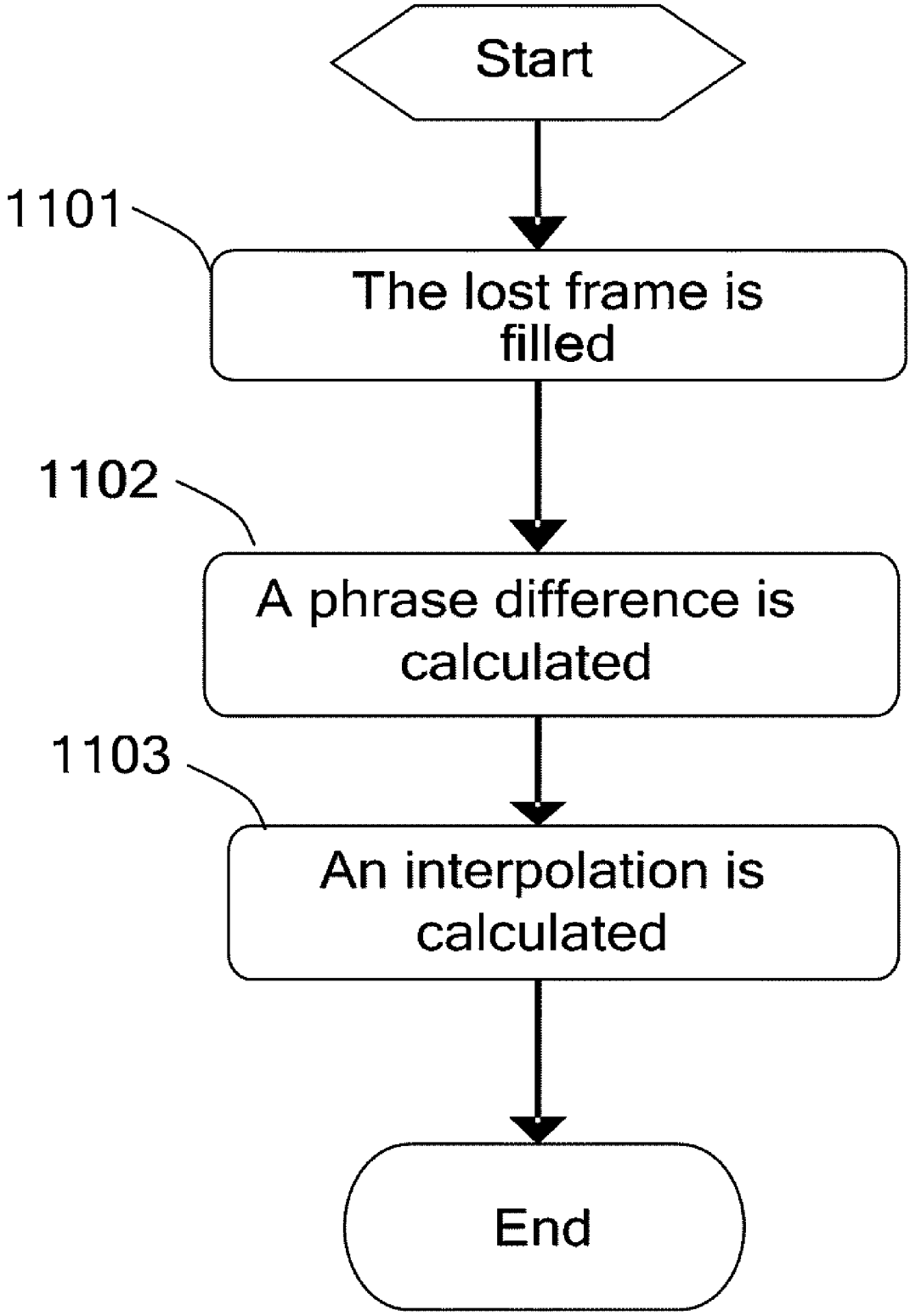
FIG. 11 shows a method for removing the mismatching between lost frame concealment phrases.

Because a pitch period is always changed, phrases are not matched when the method for repeating a pitch period is used to implement lost frame concealment. For example, the ending part of previous frame waveform that is filled in FIG. 10 does not match the beginning part of the current frame, that is, phrases are not matched. To achieve good effect of lost frame concealment, use the information about the frame following the lost frame to eliminate the effect of unmatched phrases. The literature A New Voice-Packet Reconstruction Technique (R. A. Valenzuela and C. N. Animalu, IEEE ICASSP-89, vol. 2, pp. 1334-1336, 1989) describes a method for eliminating the effect of unmatched phrases on the basis of the information about the frame following the lost frame. As shown in FIG. 11, the method includes the following steps:

In step 1101, the preceding method for repeating a pitch period or another method is used to fill in the lost frame;

In step 1102, a phrase difference is calculated as follows: As shown in FIG. 10, first a point where the beginning point of the current frame matches with the filled data is found, then the best matching point is selected from multiple matching points, and at last the phrase difference between the best matching point and the beginning point of current frame serves as the final phrase difference. For the calculation method for finding a matching point, see the relevant document of Valenzuela. In FIG. 10, two matching points exist, and are located on the left and right separately of the beginning point of current frame. The distance from these two points to the beginning point of current frame is de and dc respectively. The phrase difference between these two points and the beginning point of current frame is −de and dc respectively. If de<dc, the best matching point is the matching point on the left, and the phrase difference d=−de; otherwise, the best matching point is the matching point on the right, and the phrase difference d=dc; and In step 1103, an interpolation is calculated as follows: a linear interpolation is usually calculated with the following formula:

$$y(n)=\{x(\lceil\alpha\cdot n\rceil)-x(\lfloor\alpha\cdot n\rfloor)\}(\alpha\cdot n-\lfloor\alpha\cdot n\rfloor)+x(\lfloor\alpha\cdot n\rfloor)$$

In the formula $\alpha=(N+d)/N$, N represents the size of a frame, $\lceil\alpha\cdot n\rceil$ represents the minimum integer that is larger than $\alpha\cdot n$, $\lfloor\alpha\cdot n\rfloor$ represents the maximum integer that is smaller than or equal to $\alpha\cdot n$, x represents a sequence for filling the data without consideration of phrase matching condition and with the length being from the beginning point for filling the data to the matching point, that is, x is equal to N+d, y represents the sequence after linear interpolation, and n=1, 2 . . . , N. After an interpolation is calculated, the result after interpolation is filled to the lost frame again.

Figure 12:
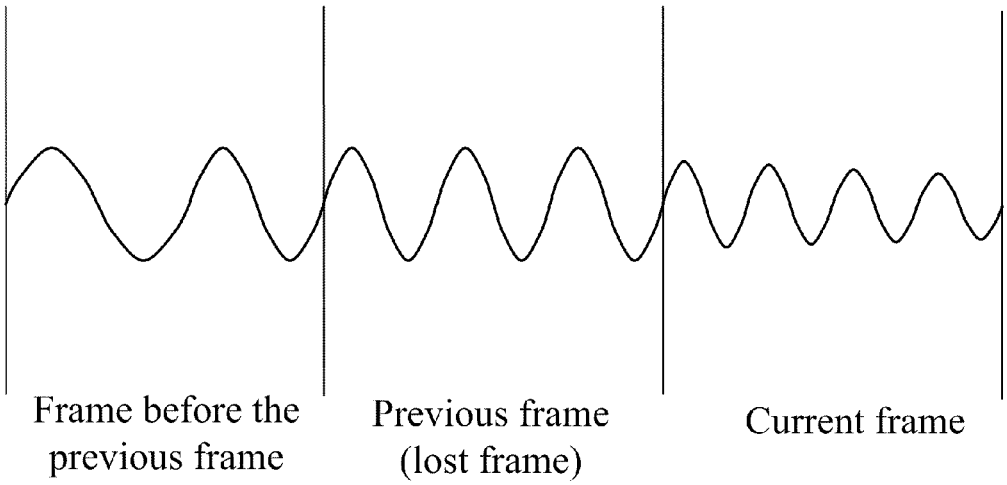
FIG. 12 is a waveform diagram after the mismatch between phrases is removed.

FIG. 12 shows the result that is obtained by using the method for removing the mismatch between phrases. Compared with FIG. 10, the problem of mismatch between phrases has been addressed.

Figure 13:
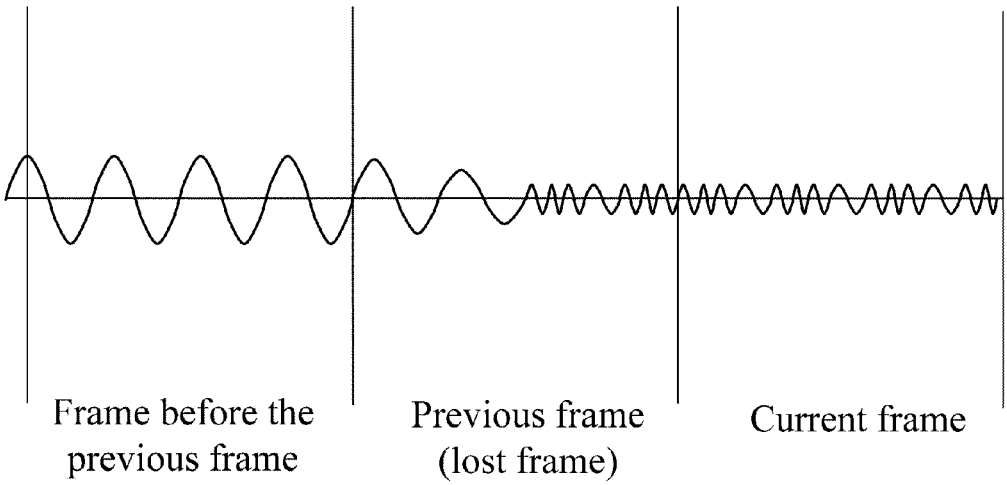
FIG. 13 is a waveform diagram of phrases where a lost frame is in the transition between surd and sonant after the lost frame concealment is implemented.

As shown in FIG. 13, a lost frame may be in the passing phrase between sonant and surd. In this case, the lost frame concealment is implemented by filling the previous frame and next frame with the sonant and surd, whose duration, however, cannot be determined accurately. A method for correct judgment is as follows:

The energy and zero-over rate of the previous frame are calculated at the encoding end, and serve as the PLC side information of the current frame. In the decoding segment, more sonant is filled if sonant components are more than surd components after the judgment about the energy and zero-over rate of the previous frame is made; otherwise, more surd is filled.

The foregoing implementation description makes it clear to those skilled in the art that the embodiment in the present invention can be implemented by either software on a necessary hardware platform or by hardware. In many cases, however, software on a necessary hardware platform is a better choice. This means that part or all of the technical solution that contributes to the background technology can be implemented by a software product. The software product can be stored in a storage medium, such as ROM/RAM, disk, and CD. The storage product includes several commands to direct a computer (a PC, server, or network device) to execute the methods provided by the embodiments of the present invention or some parts of an embodiment.

The foregoing section describes the better embodiments in the present invention and is not used to limit the embodiments protected by the present invention. All the modification, equivalent replacement, and improvement that are made without departing from the spirit and principle of the present invention are protected by the present invention.

What is claimed is:

1. A device implementing lost frame concealment, comprising:

a lost frame detector configured to receive voice data, detect whether a voice frame is lost, and generate frame loss information;

a decoding module configured to decode the received current voice frame and generate a low band decoded signal and a high band decoded signal of the current frame;

a low band delay module configured to set a delay time for the low band decoded signal of the current frame and generate a low band decoded signal of a previous frame;

a low band signal recovering module configured to recover the lost low band decoded signal of the previous frame when the frame loss information shows that the previous frame is lost;

a high band lost frame concealment module configured to receive the high band decoded signal of the current frame and the frame loss information and generate a high band decoded signal of the previous frame; and a Quadrature Mirror Filter (QMF) synthesis filter configured to one of: (i) receive the low band decoded signal of the previous frame generated by the low band delay module and the high band decoded signal of the previous frame generated by the high band lost frame concealment module, synthetically filter the low band decoded signal and the high band decoded signal, and output a previous frame voice signal; and (ii) receive the low band decoded signal of the previous frame recovered by the low band signal recovering module and the high band decoded signal of the previous frame generated by the high band lost frame concealment module, synthetically filter the low band decoded signal and the high band decoded signal, and output a previous frame voice signal.

2. The device according to claim 1, wherein: the high band lost frame concealment module is configured to judge whether the high band decoded signal of the current frame is received on the basis of the frame loss information; if the high band decoded signal of the current frame is received, the high band decoded signal of the current frame is configured to generate the high band decoded signal of the previous frame; if the high band decoded signal of the current frame is not received, the high band decoded signal of the current frame is recovered, and the high band decoded signal of the current frame is configured to generate the high band decoded signal of the previous frame.

3. The device according to claim 1, wherein: the decoding module is also configured to generate side information about lost frame concealment, and the side information about lost frame concealment includes a signal energy of lost frame and zero-over rate.

4. The device according to claim 3, wherein: the low band signal recovering module is configured to receive the side information about lost frame concealment, judge the sonant and surd components according to the signal energy and zero-over rate of lost frame in the side information about lost frame concealment, and recover the lost frame according to the sonant and surd components.

5. The device according to claim 1, wherein: the delay time is the duration of one frame, and the previous frame is the frame before the current frame.

6. A method for implementing lost frame concealment, comprising:

receiving, by a lost frame detector voice data, detecting whether a voice frame is lost, and generating frame loss information;

decoding, by a decoding module, a received current voice frame and generating a low band decoded signal of the current frame and a high band decoded signal of the current frame;

setting, by a low band delay module, a delay time for the low band decoded signal of the current frame, and generating a low band decoded signal of a previous frame or recovering, by a low band signal recovering module, the lost low band decoded signal of the previous frame when the frame loss information shows that the previous frame is lost;

receiving, by a high band lost frame concealment module the high band decoded signal of the current frame and the frame loss information and generating a high band decoded signal of the previous frame; and receiving, by a Quadrature Mirror Filter (QMF) synthesis filter, the low band decoded signal of the previous frame generated by the low band delay module and the high band decoded signal of the previous frame generated by the high band lost frame concealment module synthetically filtering the low band decoded signal and high band decoded signal and outputting a previous frame voice signal; or receiving by the QMF synthesis filter, the low band decoded signal of the previous frame recovered by the low band signal recovering module and the high band decoded signal of the previous frame generated by the high band lost frame concealment module synthetically filtering the low band decoded signal and high band decoded signal and outputting a previous frame voice signal.

7. The device method according to claim 6, wherein: the delay time is a duration of one frame, and the previous frame is the frame before the current frame.

8. The method according to claim 7, wherein the process of generating the high band decoded signal of the previous frame comprises:

judging whether the high band decoded signal of the current frame is received on the basis of the frame loss information;

generating, by using the high band decoded signal of the current frame, the high band decoded signal of the previous frame, if the high band decoded signal of the current frame is received;

recovering the high band decoded signal of the current frame, and generating, by using the high band decoded signal of the current frame, the high band decoded signal of the previous frame, if the high band decoded signal of the current frame is not received.

9. The method according to claim 8, wherein: the high band decoded signal of the current frame is used to generate the high band decoded signal of the previous frame in the following mode: a second semi-window signal of the high band decoded signal of the current frame is delayed, and then a first semi-window signal of the high band decoded signal of the current frame and a second semi-window signal of the high band decoded signal of the previous frame are superposed.

10. The method according to claim 9, wherein generating the high band decoded signal of the previous frame further comprises:

judging whether a high band decoded signal is received; and (i) if the high band decoded signal of the current frame and the high band decoded signal of the previous frame are received, delaying the second semi-window signal of the high band decoded signal of the current frame, and superposing the first semi-window signal of the high band decoded signal of the current frame and the second semi-window signal of the high band decoded signal of the previous frame, to generate the high band decoded signal of the previous frame;

(ii) if the high band decoded signal of the current frame is received, but the high band decoded signal of the previous frame is not received, recovering the second semi-window signal of the high band decoded signal of the previous frame, and the first semi-window signal of the high band decoded signal of the current frame, and superposing the second semi-window signal of the high band decoded signal of the previous frame, to generate the high band decoded signal of the previous frame;

(iii) if the high band decoded signal of the current frame is not received, but the high band decoded signal of the previous frame is received, recovering the first semi-window signal of the high band decoded signal of the current frame, and superposing the first semi-window signal of the high band decoded signal of the current frame and the second semi-window signal of the high band decoded signal of the previous frame, to generate the high band decoded signal of the previous frame; and (iv) if neither the high band decoded signal of the current frame nor the high band decoded signal of the previous frame is received, recovering the high band decoded signal of the previous frame.

11. The method according to claim 8, wherein: the high band decoded signal of the current frame is recovered in the following mode: the high band decoded signal of the current frame is used as the high band decoded signal of the previous frame.

12. The method according to claim 10, wherein the first semi-window signal of the high band decoded signal of the current frame is recovered via one of the following modes:

(i) the first semi-window signal of the high band decoded signal of the current frame is set to zero; and (ii) the first semi-window signal of the high band decoded signal of the previous frame is copied and serves as the first semi-window signal of the high band decoded signal of the previous frame.

13. The method according to claim 10, wherein the second semi-window signal of the high band decoded signal of the previous frame is recovered via one of the following modes:

(i) the second semi-window signal of the high band decoded signal of the previous frame is set to zero;

(ii) the second semi-window signal of the high band decoded signal of the frame before the previous frame is copied and serves as the second semi-window signal of the high band decoded signal of the previous frame;

(iii) the second semi-window signal of the high band decoded signal of the current frame is copied and serves as the second semi-window signal of the high band decoded signal of the previous frame; and (iv) the second semi-window signal of high band decoded signal of the frame before the previous frame is multiplied by the first semi-window to generate the first signal;

the first semi-window signal of the high band decoded signal of the current frame is multiplied by the second semi-window to generate the second signal;

the first signal and the second signal are superposed to generate a signal, which servers as the second semi-window signal of the high band decoded signal of the previous frame;

the first semi-window and the second semi-window are combined into a superposed window.

14. The method according to claim 10, wherein the high band decoded signal of the previous frame is recovered via one the following modes:

(i) the second semi-window signal of the high band decoded signal of the previous frame is recovered to generate the first signal, the first semi-window signal of the high band decoded signal of the current frame is recovered to generate the second signal, the first signal and the second signal are superposed to generate a signal, which serves as the high band decoded signal of the previous frame; and (ii) the high band decoded signal of the frame before the previous frame is used as the high band decoded signal of the previous frame.

15. The method according to claim 10, wherein the high band decoded signal of the current frame is recovered in the following mode: the high band decoded signal of the current frame is used as the high band decoded signal of the previous frame.

* * * * *

UNITED STATES PATENT AND TRADEMARK OFFICE

CERTIFICATE OF CORRECTION

PATENT NO. : 8,355,911 B2
APPLICATION NO. : 12/637295
DATED : January 15, 2013
INVENTOR(S) : Zhan et al.

It is certified that error appears in the above-identified patent and that said Letters Patent is hereby corrected as shown below:

In the Claims:

Column 14, line 5, "servers" should read -- serves --.

Signed and Sealed this
Twenty-third Day of April, 2013

Teresa Stanek Rea

Teresa Stanek Rea
*Acting Director of the United States Patent and Trademark Office*